United States Patent [19]

Tillotson et al.

[11] Patent Number: 4,758,199

[45] Date of Patent: Jul. 19, 1988

[54] TOY BALLOON

[76] Inventors: Frederick E. Tillotson, RFD 1, Dixville Notch, N.H. 03576; Blaise L. McArdle, P.O. Box 578, Marblehead, Mass. 01945

[21] Appl. No.: 102,246

[22] Filed: Sep. 28, 1987

Related U.S. Application Data

[63] Continuation of Ser. No. 858,686, May 2, 1986, abandoned.

[51] Int. Cl.[4] ..... A63H 27/10; B64B 1/40

[52] U.S. Cl. ..... 446/225; 244/31

[58] Field of Search ..... 446/220, 221, 225; 244/31, 125, 128; D21/84

[56] References Cited

U.S. PATENT DOCUMENTS

| | | | |
|---|---|---|---|
| 205,319 | 6/1878 | Tracy | 244/125 |
| D. 288,216 | 2/1987 | Jensen | D21/84 |
| 673,776 | 4/1901 | Kavanagh | 244/33 X |
| 1,427,396 | 8/1922 | Keith | 446/225 |
| 2,208,445 | 7/1940 | Bates | 446/223 X |
| 2,540,403 | 2/1951 | Meyers | 446/221 |
| 2,886,263 | 5/1959 | Ferguson | 244/31 |
| 3,298,634 | 1/1967 | Kantor et al. | 244/31 |
| 3,391,883 | 7/1968 | Curtis | 224/31 |
| 3,945,591 | 3/1976 | Cameron | 244/31 |
| 4,145,838 | 3/1979 | Mason | 446/220 |
| 4,174,082 | 11/1979 | Eshoo | 244/31 |
| 4,177,991 | 12/1979 | Meyer et al. | 446/220 |
| 4,262,864 | 4/1981 | Eshoo | 244/31 |
| 4,267,989 | 5/1981 | Skaggs . | |
| 4,704,934 | 11/1987 | Nosrati | 446/220 |

FOREIGN PATENT DOCUMENTS

| | | | |
|---|---|---|---|
| 402903 | 10/1909 | France | 446/225 |
| 6512 | of 1909 | United Kingdom | 446/225 |

*Primary Examiner*—Robert A. Hafer
*Assistant Examiner*—Michael Brown
*Attorney, Agent, or Firm*—Jones, Askew & Lunsford

[57] ABSTRACT

The present invention provides an imitation lighter-than-air craft envelope assembly for use in conjunction with an attached imitation gondola. The assembly comprises an inflatable gas bag capable of containing a gas, and an imitation envelope which surrounds the gas bag. The imitation envelope simulates an actual lighter-than-air craft envelope when the gas bag is inflated within the envelope.

8 Claims, 2 Drawing Sheets

TOY BALLOON

This application is a continuation of application Ser. No. 858,686, filed May 2, 1986, abandoned.

TECHNICAL FIELD

The present invention relates to toys or decorative articles, and more particularly relates to an imitation hot air balloon.

BACKGROUND OF THE INVENTION

Hot air ballooning has long been known as a means of air transportation and recreation. These balloons usually include a spherically-shaped nylon envelope and an attached basket-shaped passenger gondola. When the envelope is inflated with hot air, it provides enough buoyancy to lift the gondola.

These balloon envelopes often display bright colors and have a high degree of aesthetic appeal. It is therefore desirable to provide a miniature imitation hot air balloon for toy or display purposes. Howver, it is difficult to provide a balloon envelope which gives the appearance of a true hot air balloon envelope, without providing a hot air supply into the toy balloon envelope. Prior toy balloons have utilized a painted inflatable rubber balloon, which approximates the shape of a true balloon envelope, but does not provide the aesthetically desirable fabric-like appearance of a true balloon envelope.

Therefore, it is desirable to provide an imitation hot air balloon which approximates the appearance and characteristics of a true hot air balloon, yet does not require a supply of hot air.

SUMMARY OF THE INVENTION

The present invention solves the above described problems in the prior art by providing an improved imitation hot air balloon. An imitation hot air balloon according to the present invention effectively contains a buoyant gaseous substance within the envelope of the imitation balloon, while allowing the balloon envelope to be constructed of ornamental fabrics without concern for the gas sealing characteristics of the ornamental fabric.

Generally described, the imitation hot air balloon according to the present invention includes an imitation hot air balloon envelope for use in conjunction with an attached imitation gondola. The balloon envelope comprises an inflatable gas bag capable of containing a gas, and a decorative imitation envelope surrounding the gas bag. The imitation envelope substantially conforms to the gas bag when inflated by the gas, such that the imitation envelope simulates an actual hot air balloon envelope when the gas bag is inflated by the gas.

Thus, it is an object of the present invention to provide an improved imitation hot air balloon envelope.

It is a further object of the present invention to provide an imitation hot air balloon envelope which is aesthetically pleasing.

It is a further object of the present invention to provide an imitation hot air balloon envelope with buoyant properties.

It is a further object of the present invention to provide an inexpensive imitation hot air balloon envelope.

Other objects, features and advantages of the present invention will become apparent from reading the following specification when taken in conjunction with the accompanying drawings.

DETAILED DESCRIPTION

Figure 1:
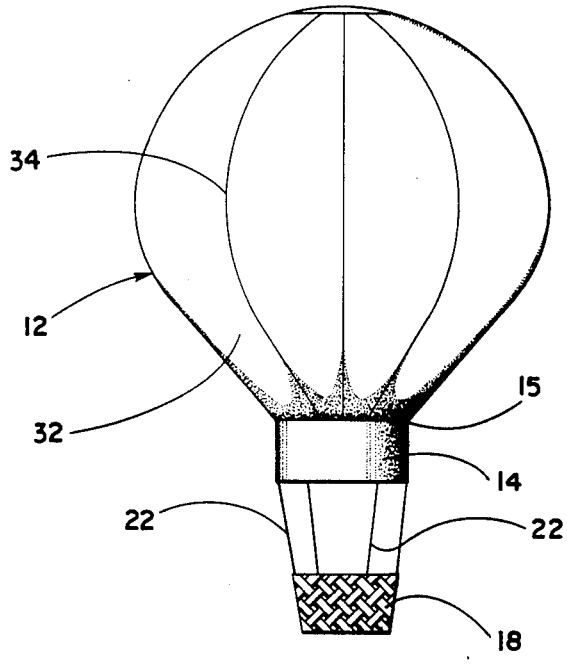
FIG. 1 is a pictorial view of an imitation hot air balloon according to a preferred embodiment of the present invention.
Figure 2:
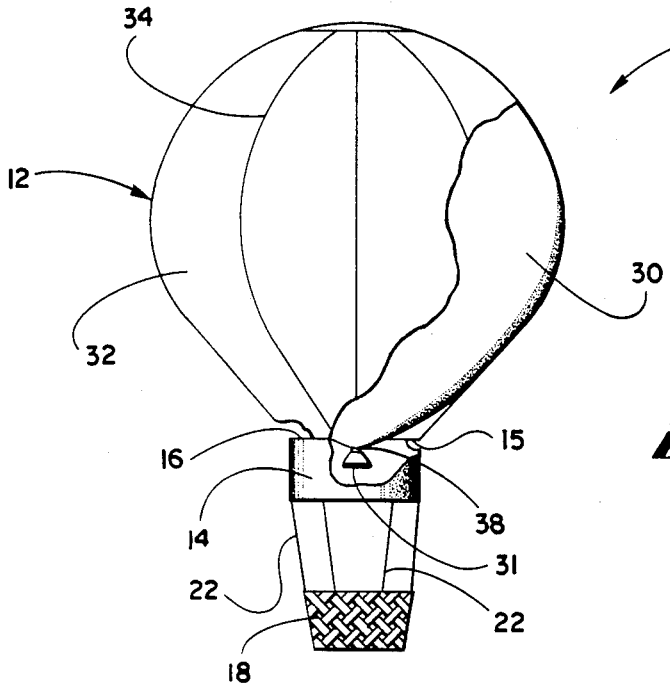
FIG. 2 is a partial cut-away view of the balloon shown in FIG. 1.

Referring now in more detail to the drawings, in which like numerals indicate like parts throughout the several views, FIGS. 1 and 2 show an assembled imitation hot air balloon assembly 10 according to a preferred embodiment of the present invention. As described in detail below, the preferred imitation hot air balloon assembly 10 includes an imitation envelope 12, a skirt 14 located immediately below the imitation envelope and attached thereto, a gondola 18 suspended below the skirt by the gondola support cords 22, and a gas bag 30 contained within the imitation envelope.

The imitation envelope 12 comprises a plurality of decorative panels 32 attached at gore seams 34 by sewing or other means known in the art. The imitation envelope 12 is substantially spherical in shape and defines a single lower circular opening defined by circular edge 15 at the bottom of the imitation envelope 12. The cylindrical skirt 14 is attached to and extends downwardly from the bottom of the external envelope 12 such that the upper circular edge 16 of the skirt mates with the lower circular edge 15 of the imitation envelope. A gondola 18 is suspended from the bottom of skirt 14 by a plurality of cords 22 simulating the gondola suspension ropes of a full-size hot air balloon.

As shown in FIG. 2, a spherical gas bag 30 containing gas and having a mouth 31 is located inside and substantially fills the interior cavity of the imitation envelope 12. The mouth 31 is sealed by a tie wire 38, or other means known in the art. It should therefore be understood that the gas bag 30 and not the imitation envelope 12, contains the gas. Therefore, the imitation envelope 12 may be constructed of a variety of decorative materials without consideration of the gas sealing capabilities of the decorative material.

Assembly of the balloon assembly 10 takes place in the following manner. A deflated gas bag 30 is inserted into imitation envelope 12 through the skirt 14. A gaseous substance is then introduced into the mouth 31 of the gas bag 30, inflating the gas bag to the desired extent. As the inflatable gas bag 30 expands, the imitation envelope 12 also expands and conforms to the shape of the gas bag. When the inflatable gas bag 30 is blown up to its desired size, the mouth 31 is then sealed by a tie wire 38.

It may thus be seen that the gas bag 30, when inflated, provides a balloon-shaped form to which the imitation envelope 12 conforms. In one preferred embodiment, gas bag 30 is sperical when inflated and therefor the imitation envelope 12 is substantially spherical when the gas bag is inflated, depending on the extent that the gas bag 30 fills the imitation envelope 12. In practice it has been found advantageous to fill the gas bag 30 with gas such that the gas bag substantially fills the imitation envelope 12, but leaves a slight amount of slack between the gas bag and the imitation envelope. This allows the fabric of the imitation envelope 12 to appear inflated yet exhibit some degree of rippling, which closely resembles an actual balloon envelope when inflated.

Therefore, it should be understood that the gas bag 30 fully contains the gas and is totally concealed by the imitation envelope 12. The imitation envelope 12 may be fabricated from a wide variety of decorative material, without concern for the gas containing capabilities of the decorative material. For example, nylon, silk, and even paper tissue fabrics have been found suitable for imitation envelope 12. However, it should be noted that care must be taken when the gas bag 30 is inflated within an imitation envelope of a fragile material such as paper tissue. If the gas bag is overinflated, the imitation envelope 12 may tear.

Figure 3:
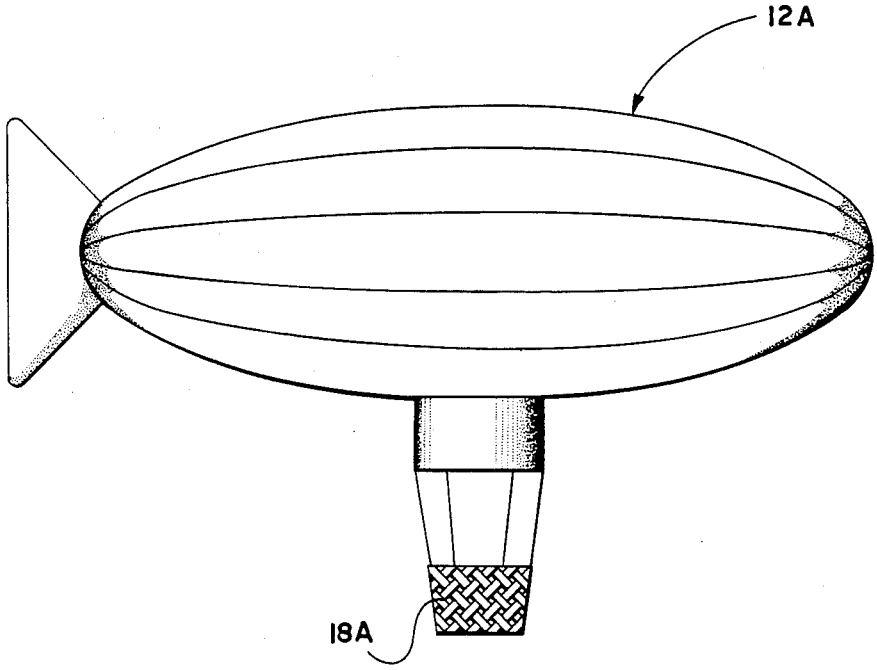
FIG. 3 is a pictorial view of an imitation hot air balloon according to an alternative embodiment of the present invention.

The gas bag 30 may be constructed of any lightweight material which can contain a gas. An actual device constructed according to one preferred embodiment utilizes an inflatable balloon comprised of a flexible latex, which stretches and expands to form a spherical shape when inflated. If it is desired that the imitation envelope 12 assume a nonspherical shape, latex balloons are available which inflate to nonspherical shapes. For example, as shown in FIG. 3, an oblong latex balloon may be utilized for the gas bag (not shown) if a dirigible-type imitation envelope 12A is desired. It will be understood that the imitation envelope 12A and enclosed gas bag, in that alternative, will normally have their longitudinal axes horizontal, with the gondola 18A attached to the underside of the imitation envelope between the two polar ends of the imitation envelope 12A.

It should be noted that the gas bag 30 need not be a stretchable elastomeric material, but need only be capable of containing a gas. For example, a relatively unstretchable material such as polyurethane may alternatively be used for gas bag 30. This may be necessary if an unconventional inflated shape is desired for the gas bag 30.

If it is desired that the balloon envelope assembly exhibit buoyancy, the entire balloon assembly 10 should preferably be fabricated of lightweight materials and the gas used must be lighter than air, such as helium. However, it may not be necessary that the balloon envelope 12 exhibit buoyancy, as it may be desired to suspend the balloon assembly 10 downwardly from a point above the balloon assembly. Therefore, the gas bag 30 may be inflated with air, and a suspension cord (not shown) may be attached to the top of the imitation envelope 12 to suspend the balloon assembly 10.

The cords 22 may be of any material which exhibits sufficient tensile strength for supporting the weight of the gondola 18 and its contents, if any. For example, nylon, cotton, or even thin wire may be used. The gondola 18 may be made of any lightweight material such as straw or paper or the like.

It will thus be seen that the present invention provides a novel and improved imitation hot air balloon which possesses a number of advantages over prior art imitation devices. A simulation hot air balloon is provided which closely simulates the appearance and characteristics of an actual hot air balloon, yet does not require a supply of hot air. A wide variety of decorative materials may be used for the balloon envelope, without concern for the gas sealing capabilities of such materials.

While this invention has been described in specific detail with particular reference to the disclosed embodiments, it will be understood that many variations and modifications can be effective within the spirit and scope of the invention as described in the appended claims.

We claim:

1. A method of assembling an imitation lighter-than-air apparatus, comprising the steps of:

(a) combining an exterior imitation envelope and a skirt, said envelope defining an interior cavity, and said skirt extending downwardly from said envelope and defining a longitudinal passage providing access to said interior cavity of said envelope;

(b) inserting an inflatable gas bag while in a substantially deflated state into said cavity through said longitudinal passage of said skirt, said gas bag having a selectively sealable mouth and capable of containing a gas;

(c) inflating said gas bag by introducing a gas through said mouth until said gas bag substantially fills said cavity defined by said imitation envelope; and (d) sealing said mouth of said gas bag, such that said apparatus imitates an actual hot-air balloon envelope and skirt.

2. The method of assembly as claimed in claim 1, wherein said gas bag is inflated by an amount of lighter-than-air gas sufficient to lift said gas bag, said envelope, and said skirt relative to the atmosphere surrounding said gas bag.

3. The method of assembly as claimed in claim 2, wherein in step "c", said gas bag is inflated such that said gas bag substantially fills said interior cavity of said envelope.

4. The method of assembly as claimed in claim 3, wherein in step "c", said gas bag is inflated such that said mouth of said gas bag is accessible through said passage after said gas bag is inflated.

5. The method of assembly as claimed in claim 2, wherein in step "c", said gas bag is inflated such that said mouth of said gas bag is accessible through said passage after said gas bag is inflated.

6. The method of assembly as claimed in claim 1, wherein in step "c", said gas bag is inflated such that said gas bag substantially fills said interior cavity of said envelope.

7. The method of assembly as claimed in claim 6, wherein in step "c", said gas bag is inflated such that said mouth of said gas bag is accessible through said passage after said gas bag is inflated.

8. The method of assembly as claimed in claim 1, wherein in step "c", said gas bag is inflated such that said mouth of said gas bag is accessible through said passage after said gas bag is inflated.

* * * * *